US007695344B2

(12) United States Patent
Nuzzo et al.

(10) Patent No.: US 7,695,344 B2
(45) Date of Patent: Apr. 13, 2010

(54) BRASSIERE HAVING SUPPORT BANDS IN BACK AND/OR SIDE PANELS

(75) Inventors: Anthony J. Nuzzo, New York, NY (US); Margaret B. Shultz, Little Falls, NJ (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 35 days.

(21) Appl. No.: 11/895,488

(22) Filed: Aug. 24, 2007

(65) Prior Publication Data

US 2009/0053975 A1 Feb. 26, 2009

(51) Int. Cl.
*A41C 3/00* (2006.01)

(52) U.S. Cl. ..... 450/75; 450/74; 450/70

(58) Field of Classification Search ..... 450/65, 450/70, 74, 75, 76, 1
See application file for complete search history.

(56) References Cited

U.S. PATENT DOCUMENTS

| | | | | | |
|---|---|---|---|---|---|
| 2,666,919 | A | * | 1/1954 | Spangard | 450/36 |
| 3,093,137 | A | * | 6/1963 | Dugan | 450/19 |
| 3,411,510 | A | * | 11/1968 | Marien | 450/70 |
| 3,566,878 | A | * | 3/1971 | Radomski | 450/65 |

* cited by examiner

*Primary Examiner*—Gloria Hale
(74) *Attorney, Agent, or Firm*—Womble Carlyle Sandridge & Rice PLLC

(57) ABSTRACT

A brassiere has a pair of breast receiving cups and a first back panel connected to one of the pair of breast receiving cups and a second back panel connected to the other of the pair of breast receiving cups. The first back panel and the second back panel each have a band affixed thereto that is capable of modifying a property of the panel. The bands limit the elongation of each of the pair of back panels during wear.

4 Claims, 2 Drawing Sheets

BRASSIERE HAVING SUPPORT BANDS IN BACK AND/OR SIDE PANELS

FIELD OF THE INVENTION

The present invention relates generally to a brassiere having a support connected to the back or side panels. More particularly, the present invention relates to a brassiere having support bands connected to the back or side panels to supplement the support provided by the shoulder straps.

DESCRIPTION OF RELATED ART

Undergarments and in particular brassieres typically have shoulder straps that enhance the support of the garment during wear. The shoulder straps are connected to the cups of the undergarment and maintain the position of the undergarment during wear. Unfortunately, such straps do not always offer the desired degree of support or comfort to the wearer.

Some brassiere straps offer the necessary support. However, the straps are excessively wide, and thus perhaps visible beneath garments or uncomfortable. In contrast, brassieres that have thin straps often do not offer the required support. Further, brassieres with thin straps may actually dig into the skin of the shoulders of the wearer.

Accordingly, there is a need for a brassiere having back or side panels that are able to support the breasts of the wearer by providing additional support to the back or side panels of the brassiere.

SUMMARY OF THE INVENTION

The present disclosure provides for a brassiere having back and/or side panels with added support to supplement the support provided by the shoulder straps.

The present disclosure also provides for a brassiere having back and/or side panels that incorporate support bands that are able to provide supplemental support for the breasts of the wearer.

The present disclosure further provides for a brassiere having support bands, in which the support bands are elasticized in a vertical or longitudinal dimension and non-elasticized in the lateral direction to provide additional support and stability around the torso of the wearer.

The present disclosure still further provides for a brassiere having integral support bands in the back and/or side panels with the support bands supplementing the support provided by the straps by minimizing the total elasticity of the torso encircling portion of the brassiere around the wearer's torso.

The present disclosure yet further provides for a brassiere having integral support bands in the back and/or side panels where the support bands have a higher modulus of elasticity than the material of the back and/or side panels to minimize the total elasticity of the torso encircling portion of the brassiere around the wearer's torso.

These and other advantages and benefits are provided by a brassiere having a pair of breast receiving cups and a first back panel connected to one of the pair of breast receiving cups and a second back panel connected to the other of the pair of breast receiving cups. The first back panel and the second back panel each have a band affixed thereto that is capable of modifying a property of the panel.

A brassiere having a pair of back panels that are connected to one of a pair of breast receiving cups is provided. A first band affixed to one of the pair of back panels and a second band affixed to the other of the pair of back panels is provided. Each of the bands has a first modulus of elasticity and each of the pair of back panels has a second modulus of elasticity. The first modulus of elasticity is greater than the second modulus of elasticity.

Also, a brassiere having a pair of back panels and at least one band affixed to each of the pair of back panels is provided. The at least one band limits the elongation of each of the pair of back panels during wear.

BRIEF DESCRIPTION OF THE DRAWINGS

These and other advantages and benefits of the present disclosure will be more apparent from the following detailed description of the present disclosure, in conjunction with the accompanying drawings.

DETAIL DESCRIPTION OF THE INVENTION

Figure 1:
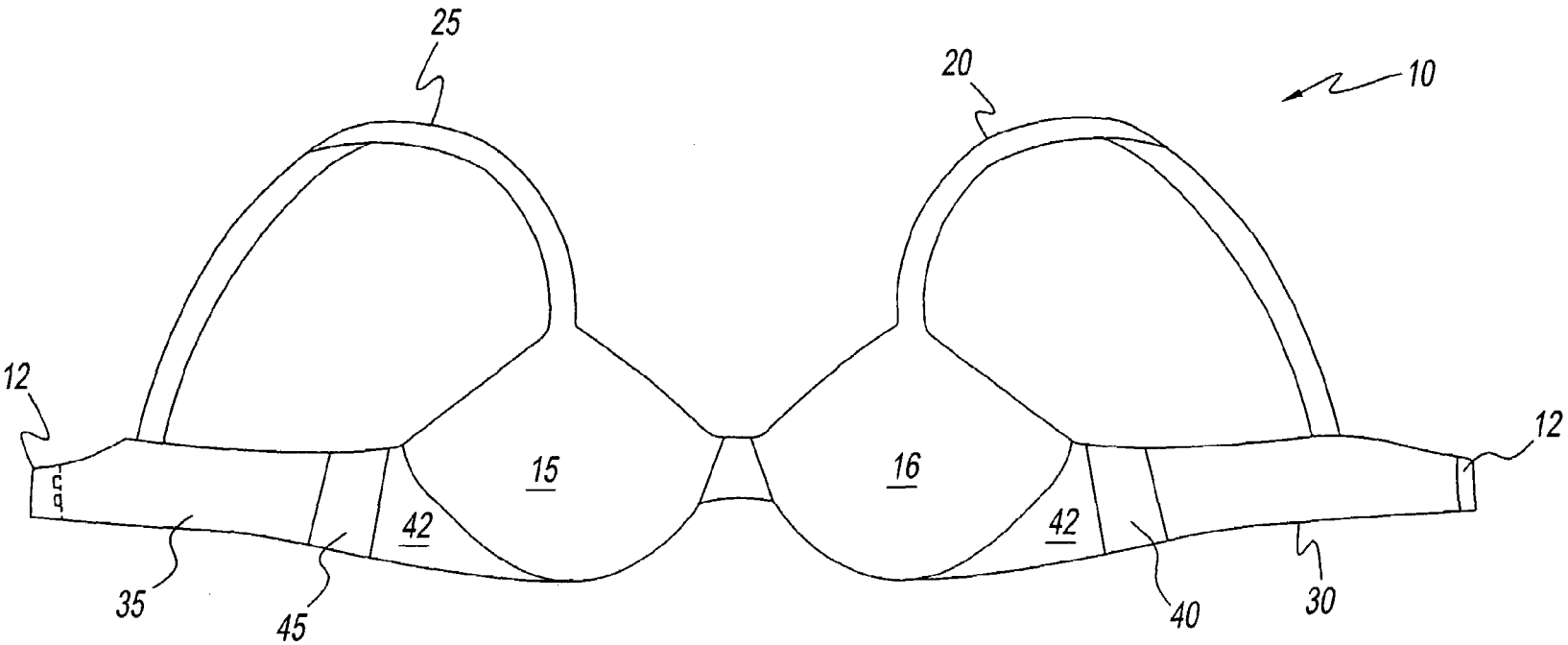
FIG. 1 illustrates a front view of a brassiere that incorporates the bands of the present invention.

Referring to the drawings, and in particular to FIG. 1, a brassiere is shown and generally referred to with reference numeral 10. Brassiere 10 has two breast receiving cups 15 and 16 and a pair of shoulder straps 20 or 25. Brassiere 10 also has back panels 30 and 35. Each back panel 30 and 35 has a portion of a fastener 12, preferably to fasten brassiere 10 around the torso of a wearer. Back panels 30 and 35 have support bands 40 and 45, respectively, connected thereto. While brassiere 10 is shown as having support bands 40 and 45 in back panels, a brassiere having support bands 40 and 45 positioned in the wing is also within the scope of the present disclosure.

Back panels 30 and 35 are elasticized in all directions to provide comfort and stretchability around the torso of the wearer. Back panels 30 and 35 together with shoulder straps 20 maintain the general position of brassiere 10 on the body of the wearer.

Figure 2:
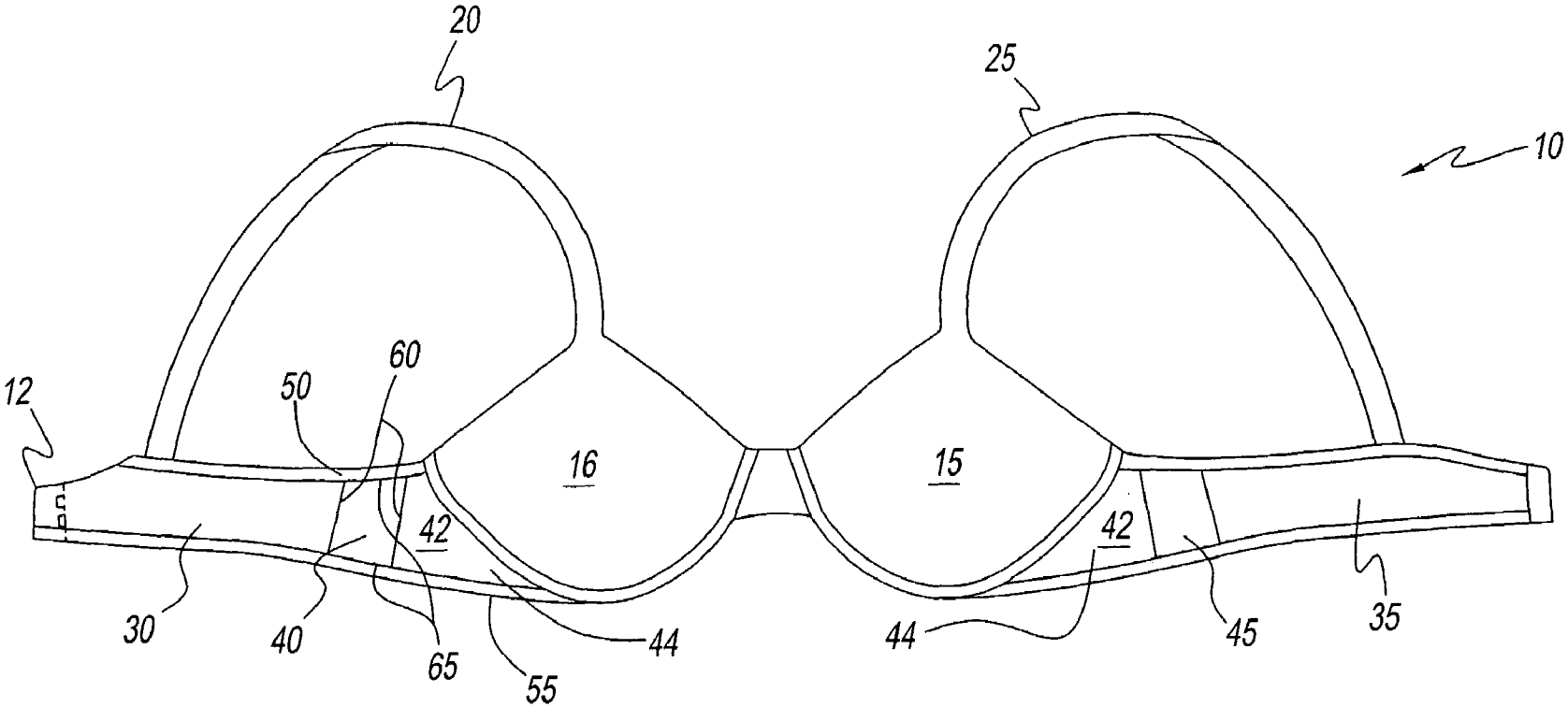
FIG. 2 illustrates a back view of a brassiere of the inside of the brassiere that incorporates the bands of the present invention.

Referring to FIG. 2, back panel 30 and its relevant features are identical to the features of back panel 35, and thus back panel 30 only will be referenced for purposes of illustration. Back panel 30 has an upper edge 50 and a lower edge 55. Back panel 30 has a support band 40 connected thereto. Back panel 30 has a transition zone 42 between breast receiving cup 16 and support band 40. Transition zone 42 has an approximately triangular shape with a portion thereof 44, under a portion of breast cup 15, 16. Support band 40 has lateral edges 60 that are secured to back panel 30. Support band 40 has opposing edges 65 that are secured beneath upper edge 50 and lower edge 55 of back panel 30.

Support band 40 is elasticized in the longitudinal direction, which is the direction parallel or substantially parallel with the spine of the wearer, and substantially non-elasticized in the lateral direction, which is the direction parallel or substantially parallel with the torso of the wearer once the brassiere is on the wearer. Support bands 40 and 45 have a higher modulus of elasticity in both the longitudinal and lateral directions relative to the modulus of elasticity of back panels 30 and 40. By being substantially non-elasticized in the lateral direction around the torso of the wearer, support bands 40 and 45 limit the overall elongation of back panels 30 and 35, respectively. By limiting the overall elongation of back panels 30 and 40, the close fit of brassiere 10 around the torso is ensured because of the restrictive effect of support bands 40 and 45.

The higher modulus of elasticity of support bands 40 and 45, relative to the modulus of elasticity of back panels 30 and 35, respectively, in combination with their proximity of the bands to the breast receiving cups 15 and 16 provide a supporting function that supplements the support function of shoulder straps 20 and 25. Were support bands 40 and 45 not present, the entire torso encircling portion of brassiere 10 would be elasticized and there would not be any supplemental support for brassiere 10.

Alternatively, support bands 40 and 45 can be non-elasticized in both the longitudinal and lateral directions. By not being elasticized in either direction, the support bands 40 and 45 limit the elongation of back bands 30 and 35, respectively, in both the longitudinal and lateral directions. When support bands 40 and 45 are non-elasticized, a close fit of brassiere 10 around the torso of the wearer is ensured.

Support bands 40 and 45 are positioned proximate and at an angle relative to a respective breast receiving cup 16, 15. This proximity is optimal because transition zones 42 of each back band 30 and 35 are shortened, thus limiting their overall contribution to the brassiere length while still offering mobility. The angle of support bands 40, 45 relative to breast receiving cups 16 and 15 ensures that the bands are close to the chest wall of the wearer. Thus, support bands 40 and 45 are able to provide additional stability to support the breast, breast tissue or bosom of the wearer of brassiere 10 that would not be possible with straps alone. For women with large breasts, support bands 40 and 45 are preferably proximate breast receiving cups 15 and 16 for maximum and optimal support.

While the present disclosure shows an underwire brassiere 10 incorporating support bands 40 and 45, support bands may also be used with any other type of brassiere having back or side panels.

While bands 40 and 45 are each shown as a single band, each band can be multiple smaller bands, provided they accomplish a similar support function along the length of back panels 30 and 40, respectively.

While the present disclosure has been described with reference to one or more exemplary embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this disclosure, but that the disclosure will include all embodiments falling within the scope of the disclosure.

We claim:

1. A brassiere, comprising:

(a) a pair of breast receiving cups;

(b) a support band elasticized in a vertical direction and connected proximate to each of the pair of breast receiving cups, and having a modulus of elasticity in a lateral torso encircling direction and a modulus of elasticity in the vertical direction;

(c) a back panel elasticized in a lateral torso encircling direction and in a vertical direction connected to and extending outwardly from each of the support bands and having a modulus of elasticity in the lateral torso encircling direction and a modulus of elasticity in the vertical direction; and (d) each support band has a modulus of elasticity in the lateral direction and vertical direction greater than the modulus of elasticity in the lateral direction and vertical direction of each back panel.

2. The brassiere of claim 1, further comprising a transition region between each breast receiving cup and each support band.

3. A band construction for a brassiere having a pair of breast receiving cups covering portion with opposed side edges, comprising:

(a) a support band elasticized in a vertical direction and configured for connection proximate to each of the pair of breast receiving cups, and having a modulus of elasticity in a lateral torso encircling direction and a modulus of elasticity in a vertical direction;

(c) a back panel elasticized in a lateral torso encircling direction and in a vertical direction connected to and extending outwardly from each of the support bands and having a modulus of elasticity in the lateral torso encircling direction and a modulus of elasticity in a vertical direction; and (d) each support band has a modulus of elasticity in the lateral direction and vertical direction greater than the modulus of elasticity in the lateral direction and vertical direction of each back panel.

4. The band construction of claim 3, further comprising a transition region between each opposed side edge of the front breast covering portion and each support band.

* * * * *